United States Patent [19]

Leskovec et al.

[11] Patent Number: 4,751,983

[45] Date of Patent: Jun. 21, 1988

[54] LOAD LIFTING DEVICE LOAD SENSING

[75] Inventors: Edward V. Leskovec, Eastlake; Richard A. Schwehr, Mentor, both of Ohio

[73] Assignee: Caterpillar Industrial Inc., Mentor, Ohio

[21] Appl. No.: 18,557

[22] Filed: Feb. 25, 1987

[51] Int. Cl.[4] ..... B66B 9/20

[52] U.S. Cl. ..... 187/9 R; 250/222.1; 356/400

[58] Field of Search ..... 187/1 R, 9 R, 9 E, 28; 414/273, 274, 674, 785; 250/222.1, 223 R, 239; 356/375, 400

[56] References Cited

U.S. PATENT DOCUMENTS

| | | | |
|---|---|---|---|
| 3,672,470 | 6/1972 | Ohntrup et al. | 187/1 |
| 4,212,375 | 7/1980 | Peterson et al. | 187/9 |
| 4,294,543 | 10/1981 | Apple et al. | 356/375 |
| 4,564,085 | 1/1986 | Melocik et al. | 250/222.1 |

FOREIGN PATENT DOCUMENTS 6115040 4/1986 Japan .

*Primary Examiner*—Joseph J. Rolla

*Assistant Examiner*—Kenneth Noland

*Attorney, Agent, or Firm*—Alan J. Hickman

[57] ABSTRACT

Sensors associated with load carrying members are inaccurate, incorrectly sense the position of the load, and are subject to impact forces which cause premature sensor failure. A load lifting device having a load carrying member and first and second sensors and first and second reflectors on the load carrying member is provided. The sensors are mounted on a first end portion of load carrying member at longitudinally spaced apart locations and the first and second reflectors are mounted on a second end portion of the load carrying member at spaced apart locations on the second end portion. The first sensor delivers a first signal to the first reflector and receives a reflection of the first signal, and the second sensor delivers a second signal to the second reflector and receives a reflection of the first signal from the second reflector. The problems associated with inaccurate sensing of load position, damage to the sensors by impact, and premature wear due to cyclical forces are substantially reduced. The load lifting device is particularly suited for use on a material handling vehicle of the automatic guided vehicle type.

24 Claims, 4 Drawing Sheets

15
16
18
18
144
13
28
26
30
20
22
24
32
32'
34
34'
36
36'
38
38'
40
40'
42
42'
46
46'
48
48'
50'
52
52'
58
60
62
64
66
68
70
72
74
76
78
80
82
86
90
92
94
96
98
100
102
104
110
112
118
120
126
132
134
136
138
III

LOAD LIFTING DEVICE LOAD SENSING

TECHNICAL FIELD

This invention relates to a load lifting device having a load carrying member and sensors for determining the presence of a load on the load carrying member, and more particularly, to a lift mast assembly for a material handling vehicle having a plurality of load carrying members and first and second sensors and reflectors on each of the first and second load carrying members for sensing the presence and position of a load on the load carrying members.

BACKGROUND ART

Load lifting devices having load carrying members suitable for engaging and carrying a load have been in use for many decades. Typically, the load lifting device (masts, booms, and lifting linkages) is mounted on a vehicle and supports the load carrying members (forks and the like) for elevational movement relative to the vehicle. Some examples of vehicles of this type include lift trucks, telescopic material handlers, and track and wheel loaders. The load carrying members, which includes material handling forks, are mounted on the load lifting device and elevationally movable for retrieving and depositing loads at various elevational locations.

In order to lift a load, the load lifting device must be positioned so that the load carrying members are disposed beneath the load. The load carrying members are then elevated until the load is engaged by and fully supported thereon. During this loading process, there is a strong potential for the load to become skewed, pitched, and tipped relative to the load carrying members resulting in the load not being squarely carried on the load carrying member. The load not being accurately positioned on the load carrying member would adversely effect material handling and load transferring operations. This is particularly important in automated manufacturing and storage systems where driverless automatic guided vehicles are used to transport loads. Therefore, there is a need to sense when a load is squarely and properly positioned on the load carrying members so that the material handling function may be carried out with a maximum amount of efficiency and accuracy.

One attempt to solve a portion of this problem is taught in Japanese Patent Publication No. 61-15040, 1986 to Kabushiki Kaisha Komatsu Seisakusho, dated April 22. In this publication, a mechanical touch switch is provided on a load carrying member of a lift truck lift mast assembly adjacent a juncture of connection between the vertically and horizontally extending portions of the load carrying member. This, however, is an unsatisfactory solution for several reasons. Since the switch is mechanical and requires physical movement of a mechanical actuator to actuate the switch, there is the potential for switch failure due to excessive forces being applied to the switch and the mechanical switch actuator by the load.

Also, the mechanical switch actuator is frequently subjected to cyclical forces caused by loading and unloading of the load. Thus, improper switch adjustment due to wear, bending, movement and the like occurs. This causes improper switch operation and results in inaccurate, incorrect, and erroneous sensing of the actual position of the load on the load carrying members. As a result, placement of the load during load transfer operations is inaccurate and requires frequent adjustment of the switch and switch actuator.

The switch of the above-noted Japanese Patent is connected to the load carrying member adjacent the juncture of connection of the first and second end portions of the load carrying member so that the switch will be closed whenever an end portion of the load nearest the juncture of connection of the load carrying members horizontally and vertically oriented end portions (first and second end portions) contacts the mechanical switch actuator. This assumes that when the end portion of the load adjacent the switch is properly positioned that the entire load is properly positioned and squarely at rest on the second end portion of each of the load carrying members. This is, of course, a false assumption since the load may be skewed and/or tipped and/or tilted relative to the second end portions of the load carrying member while making contact with the mechanical switch actuator. Therefore, no positive and accurate sensing arrangement has been provided to sense when a load is squarely at rest on the load carrying members second end portion and closely adjacent the first end portion of the load carrying member.

DISCLOSURE OF THE INVENTION

In one aspect of the present invention, a load lifting device having a load carrying member is provided. The load carrying member has a first end portion and a second end portion extending outwardly from the first end portion. A first sensing means delivers a first signal from a first location adjacent the first end portion and receives a reflection of the first signal, and a second sensing means delivers a second signal from the second location adjacent the first end portion and receives a reflection of the second signal. A first reflecting means receives the first signal at a first reflecting location adjacent the second end portion and delivers a reflection of the first signal in a direction towards the first sensing means, and a second reflecting means receives the second signal at a second reflecting location adjacent the second end portion and delivers a reflection of the second signal in a direction toward the second sensing means. The first and second reflecting means is spaced from one another and the second location is at a lower elevation than the first location.

In another aspect of the present invention, a lift mast assembly having a pair of spaced apart uprights, a carriage mounted on and elevationally movable along the pair of spaced apart uprights, and first and second load carrying members each having a first end portion and a second end portion extending outwardly from the first end portion is provided. The first end portions are connected to the carriage at spaced apart locations on the carriage. A first sensing means is provided for delivering the first signal from a first location adjacent the first end portion of the first load carrying member and receives a reflection of the first signal. A second sensing means is provided for delivering a second signal from the second location adjacent the first end portion of the first load carrying member and receives a reflection of the second signal. A third sensing means is provided for delivering a third signal from a third location adjacent the first end portion of the second load carrying member and receives a reflection of the third signal. A fourth sensing means is provided for delivering a fourth signal from a fourth location adjacent the first end portion of the second load carrying member and receives a reflection of the fourth signal. The second location is at a lower elevation than the first location and the fourth location is at a lower elevation than the third location. A first reflecting means is provided for receiving the first signal at a first reflecting location adjacent the second end portion of the first load carrying member and delivering a reflection of the first signal in a direction toward the first sensing means. A second reflecting means is provided for receiving the second signal at a second reflecting location adjacent the second end portion of the first load carrying member and delivering a reflection of the second signal in a direction toward the second sensing means. A third reflecting means is provided for receiving the third signal at a third reflecting location adjacent the second end portion of the second load carrying member and delivering a reflection of the third signal in a direction toward the third sensing means. And a fourth reflecting means is provided for receiving the fourth signal at a fourth reflecting location adjacent the second end portion of the second load carrying member and delivering a reflection of the fourth signal in a direction toward the fourth sensing means. The first and second reflecting locations are spaced from one another and the third and fourth reflecting locations are spaced from one another.

In yet another aspect of the present invention, an automatic guided vehicle having a vehicle frame, a longitudinal axis, a pair of spaced apart elevationally oriented uprights connected to the vehicle frame and longitudinally movable relative to the vehicle along the longitudinal axis between spaced apart locations on the vehicle frame, and a carriage mounted on and movable along the pair of spaced apart uprights between elevationally spaced apart positions is provided. The first and second load carrying members each have a first end portion and a second end portion which extends outwardly from the first end portion. The first end portions are elevationally oriented and connected to the carriage at spaced apart locations. A first sensing means is provided for delivering a first signal from a first location adjacent the first end portion of the first load carrying member and for receiving a reflection of the first signal. A second sensing means is provided for delivering a second signal from a second location adjacent the first end portion of the first load carrying member and for receiving a reflection of the second signal. A third sensing means is provided for delivering a third signal from a third location adjacent the first end portion of the second load carrying member and for receiving a reflection of the third signal. A fourth sensing means is provided for delivering a fourth signal from a fourth location adjacent the first end portion of the second load carrying member and for receiving a reflection of the fourth signal. The second location is positioned at a lower elevation than the first location and the fourth location is positioned at a lower elevation than the third location. A first reflecting means is provided for receiving the first signal at a first reflecting location adjacent the second end portion of the first load carrying member and for delivering a reflection of the first signal in a direction towards the first sensing means. A second reflecting means is provided for receiving the second signal at a second reflecting location adjacent the second end portion of the first load carrying member and for delivering a reflection of the second signal in a direction toward the second sensing means. A third reflecting means is provided for receiving a third signal at a third reflecting location adjacent the second end portion of the second load carrying member and for delivering a reflection of the third signal in a direction toward the third sensing means. A fourth reflecting means is provided for receiving a fourth signal at a fourth reflecting location adjacent the second end portion of the second load carrying member and for delivering the reflection of the fourth signal in a direction toward the fourth sensing means. The first and second reflecting locations are spaced from one another and the third and fourth reflecting locations are spaced from one another.

Since the sensing and reflecting means are free from contact with the load at all times during operation, the potential for damage is substantially reduced. Therefore system operation will be continuous and uninhibited. Because the sensing means rely on signal interference rather than mechanical actuation, the potential for failure due to wear is eliminated. Thus, the reliability of the system is greatly improved.

The sensing and reflecting means are positioned to not only determine when the load is appropriately and closely positioned adjacent the first end portion of the load carrying members but also whether or not the load is accurately supported on the second end portion of the load carrying members. Therefore, the problems with the load being cocked, skewed, tilted, or tipped are overcome since the sensors require the load to be squarely placed on the load carrying members. In situations where the load is not squarely placed on the load carrying members, not all the sensors will be actuated. Therefore operation of the lift mast assembly and/or vehicle will be conditioned to respond in a preselected manner.

The signals delivered by the sensing means must receive a positive reflection of the light signal from the associated reflecting means in order to send a signal to the control unit telling the control unit that the load is properly placed on the load carrying members. Because the signals require this positive reflection, the potential for inadvertent signals being delivered is reduced.

BEST MODE FOR CARRYING OUT THE INVENTION

Figure 1:
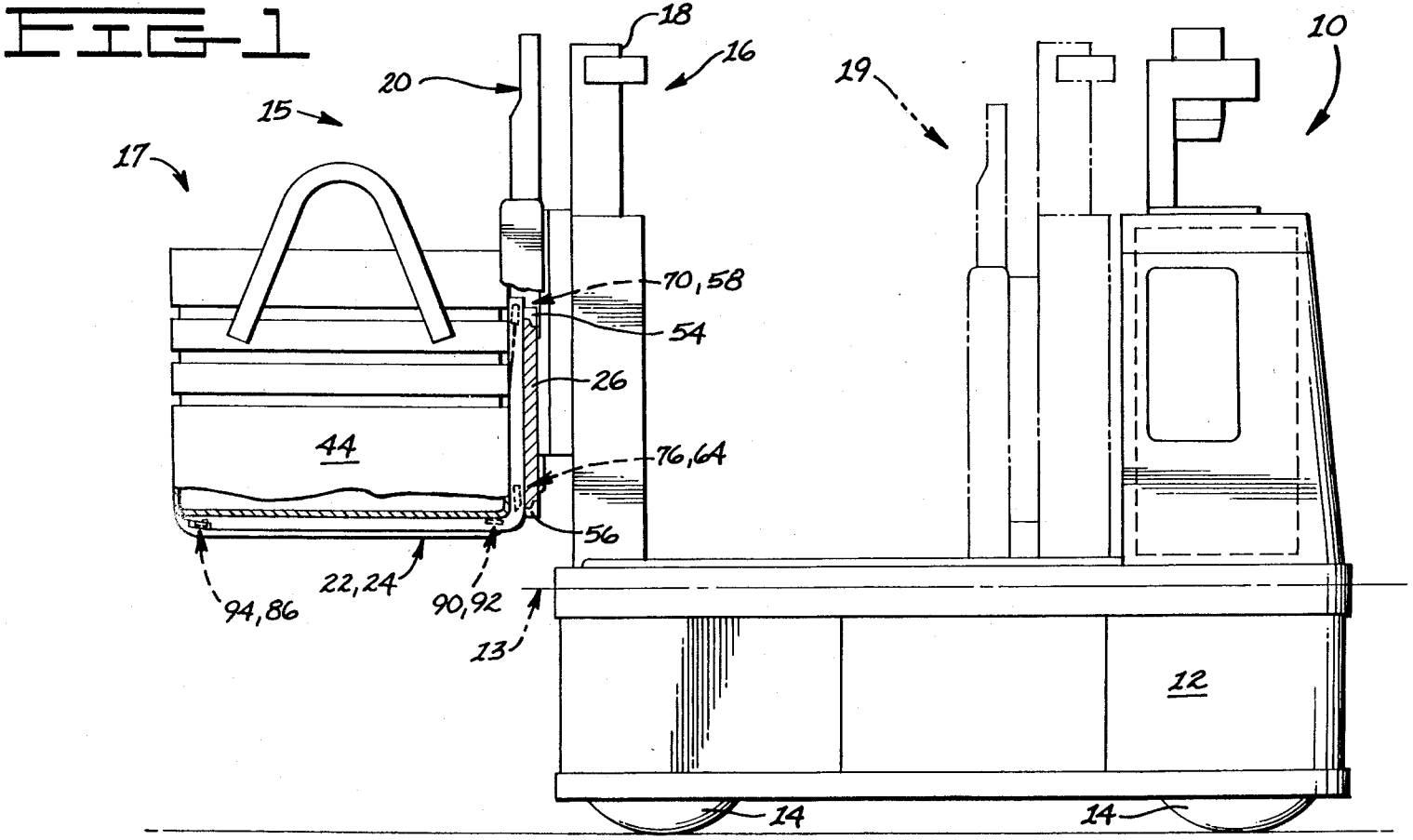
FIG. 1 is a diagrammatic side elevational view of a material handling vehicle showing a lift mast assembly mounted on the vehicle, a carriage mounted on the lift mast assembly, a load carrying member mounted on the lift mast assembly, sensing and directing means mounted on the load carrying member and a load squarely carried on the load carrying member.

With reference to the drawings, a material handling vehicle 10, which is preferably an automatic guided vehicle of the driverless free ranging type, has a frame 12, a longitudinal vehicle axis 13, and a plurality of ground engaging wheels 14. At least one of the wheels 14 is connected to a suitable prime mover such as an electric motor, hydraulic motor, and the like (not shown) for propelling the vehicle 10 over the underlying surface. A lift mast assembly 16 of a type well-known in the art has a pair of spaced apart uprights 18, a carriage 20 mounted on the pair of spaced apart uprights and elevationally movable along the uprights 18, and a first and second load carrying member 20,22 mounted on the carriage 20 at spaced apart locations on the carriage. The lift mast assembly 16 is mounted on the frame 12 and movable along the longitudinal axis 13 between a load lifting position 17 adjacent an end of the vehicle and a load carrying position 19 (shown in phantom) longitudinally spaced from the load lifting position 17 and between vehicle ends.

Figure 2:
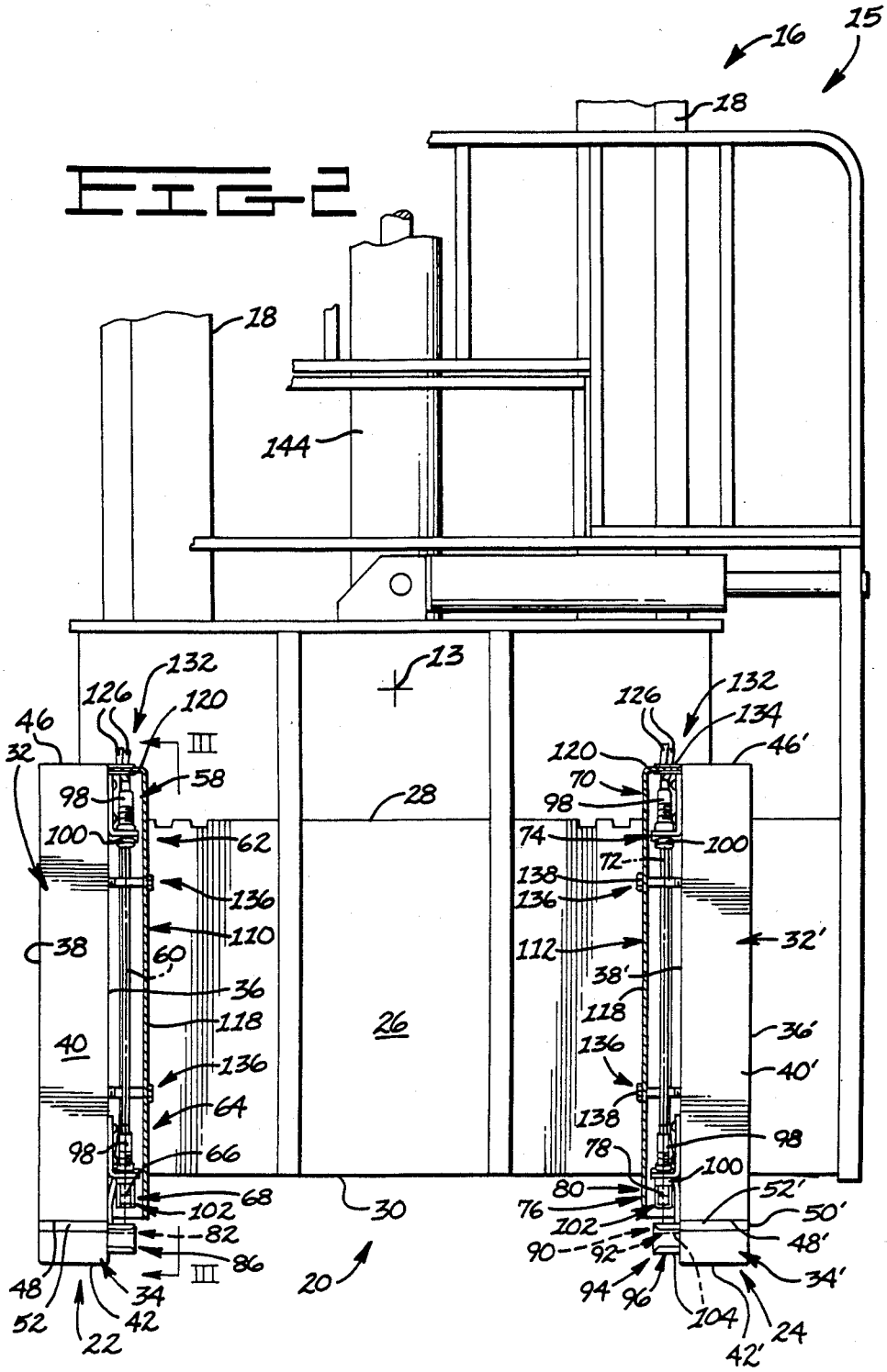
FIG. 2 is an enlarged partial diagrammatic front elevational view of the material handling vehicle of FIG. 1 showing the load carrying members, the carriage, a portion of the lift mast assembly, and first, second, third, and fourth sensing and reflecting means in greater detail.

As best seen in FIG. 2, the carriage 20, which is shown as a conventional hook type carriage, includes a support flange 26 having first and second spaced apart parallel guide surfaces 28, 30 which extend in a direction transverse to uprights 18. A roller bracket assembly (not shown) mounts the support flange 26 on the pair of spaced apart uprights 18 and guides the carriage 20 for elevational movement along the uprights 18 in a usual and customary manner. It is to be noted that shaft type carriage of a conventional construction could be substituted for the hook type carriage described above without departing from the spirit of the invention.

Figure 3:
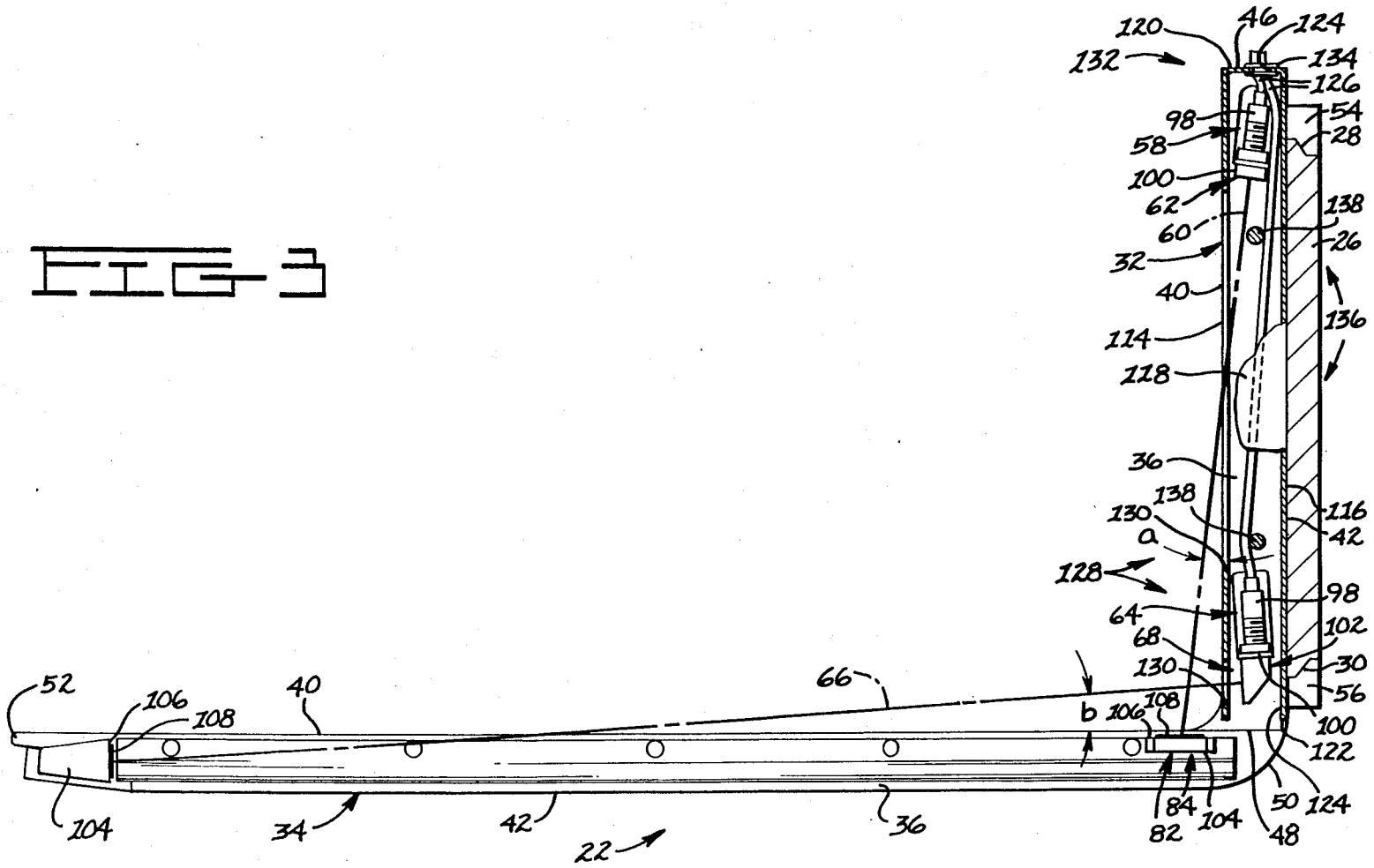
FIG. 3 is an enlarged diagrammatic view taken along lines III—III of FIG. 2 with portions broken away showing the sensing and reflecting means in greater detail.
Figure 4:
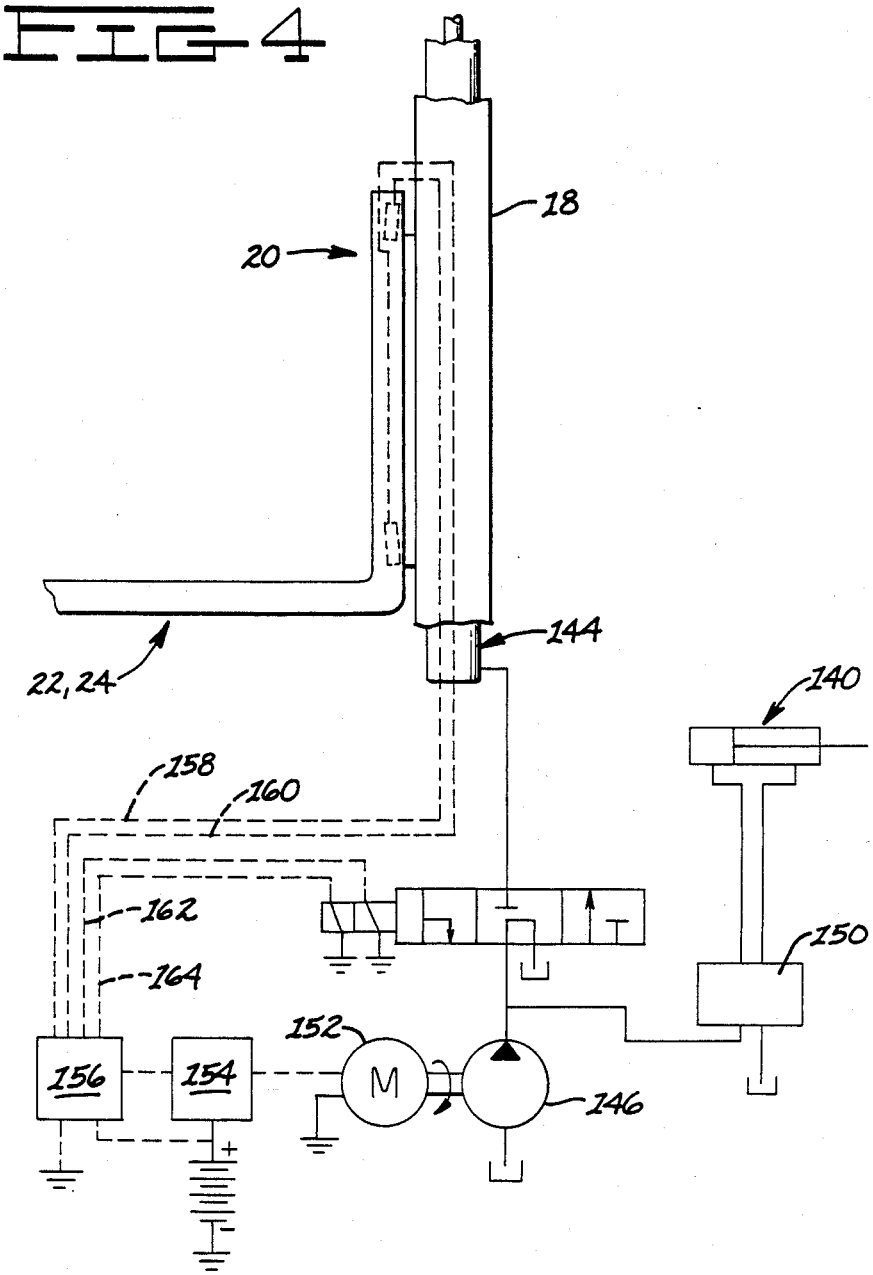
FIG. 4 is a diagrammatic schematic representation of a control system suitable for controlling operation of the lift mast assembly in response to signals delivered from the sensing means.

Referring to FIGS. 2 and 3, the first and second load carrying members 22,24 are identical in construction. Therefore, all discussion related to the construction of one of the first and second load carrying members 22,24 will also relate to the construction of the other of the first and second load carrying members 22,24. To simplify matters, the second load carrying member 24 will be identified by the same numerals as that of the first load carrying member followed by a prime. The first load carrying member 22 has a first end portion 32 and a second end portion 34 which is connected to the first end portion and extends from the first end portion in a direction substantially normal to the first end portion 32. The first end portion 32 is elevationally oriented and substantially parallel to the uprights 18. The second load carrying member 24 has first and second end portions 32',34'. The second end portion 34' is connected to the first end portion 32' and extends in an outward direction from the first end portion 32'. The first end portion 32' is elevationally oriented and substantially parallel to the uprights 18. The second end portion 34' is substantially normal to the first end portion 32'. The first load carrying member 22 has first and second spaced apart opposed surfaces 36, 38 and third and fourth spaced apart opposed surfaces 40, 42 extending between the first and second surfaces 38,36. The second load carrying member 24 also has first and second opposed spaced apart surfaces 36',38' and third and fourth opposed spaced apart surfaces 40'42' which extend between the first and second surfaces 36',38'. The third surfaces 40,40' are supportingly engagable with a load 44 (FIG. 1) to be lifted and transported by vehicle 10. The first end portion 32 has first and second ends 46,48 and the second end portion 34 has first and second ends 50,52. The second end 48 is connected to the third surface 40 of the second end portion 34. The second load carrying member 24 has first and second spaced apart ends 46',48' on the second load carrying members first end portion 32' and first and second spaced apart ends 50',52' on the second load carrying members first end portion 34'. The second end 48' is connected to surface 40' in any suitable manner. It is to be noted that the first and second load carrying members 24 may be fabricated or forged to form a unitary member capable of satisfactorily supporting load 44.

The first and second load carrying members 22, 24 are connected to the carriage 20 at transversely spaced apart locations on the carriage relative to the uprights 18. Specifically, the first end portion 32 of the first load carrying member 22 is slidably mounted on the carriage 20 by first and second spaced apart hooks 54,56. The first hook 54 is connected to the fourth surface 42 by welding at a location adjacent the first end 46 of first end portion 32 and the second hook 56 is connected to the fourth surface 42 by welding at a location adjacent the second end 48 of the first end portion 32. The first and second hooks are slidably engaged with the first and second guide surfaces 28,30, respectively which permits longitudinal adjustments of the first load carrying member on the support flange 26.

In an identical manner, the second load carrying member 24 is slidably connected at the first end portion 32 to the support flange 26 so that positioning of the second load carrying member 24 in directions transverse to the uprights 18 and relative to the first load carrying member 22 may be provided. Since the second load carrying member 24 is mounted in an identical manner to that of the first load carrying member 22, no further discussion will be made. It is to be noted that the first surface 36 of the first load carrying member 22 is spaced from the second surface 38' of the second load carrying member, and the first surface 36 of the first load carrying member 22 faces the second surface 38' of the second load carrying member 24 while installed on the carriage 20.

A first sensing means 58 is provided for delivering a first signal 60 from a first sensing location 62 adjacent the first end portion 32 of the first load carrying member 22 and for receiving a reflection of the first signal 60. Specifically, the first sensing means is mounted on the first surface 36 and the first location is adjacent the first end 46 of the first load engaging member. Preferably, the first sensing means 58 is located between the third and fourth surfaces 40,42 and first and second surfaces 36,38' so that the first sensing means 58 is protected from contact by external items and subsequent damaging forces.

A second sensing means 64 is provided for delivering a second signal 66 from a second sensing location 68 adjacent the first end portion 32 of the first load carrying member 22 and for receiving a reflection of the first signal 66. The first sensing means 64 is connected to the first surface 36 of the first load carrying member 22, first end portion 32 at said second location 68 which is adjacent the second end 48 of the first end portion 32. Preferably, the second sensing means is located between the third and fourth surfaces 40,42 and between the first and second sides 36,38'. It is to be noted that the first and second sensing means 58,64 are elevationally spaced from one another and the second sensing location 68 is at a lower elevation than the first sensing location 62. Because the second sensing means is positioned between the third and fourth surfaces 40,42 and the first side 36 and second side 38', the potential for damage due to impact by external objects will be substantially reduced.

A third sensing means 70 is provided for delivering a third signal 72 from a third sensing location 74 adjacent the first end portion 32' of the second load carrying member 24 and for receiving a reflection of the third signal 72. The third sensing means 70 is preferably located adjacent the first end 46' of the second load carrying member 24 first end portion 32'. The third sensing means 70 is preferably located at the third sensing location 74 and between the third and fourth surfaces 40',42' of the second load carrying member 24 first end portion 32' and between the first surface 36 and second surface 38 of the first and second load carrying members 22,24. Being located where mentioned above will protect the third sensing means 70 from impact and contact with external objects and therefore reduce the potential for damage to the third sensing means 70.

A fourth sensing means 76 is provided for delivering a fourth signal 78 from a fourth sensing location 80 adjacent the first end portion 32' of the second load carrying member 24 and for receiving a reflection of the fourth signal 78. The fourth sensing location 80 is elevationally spaced from the third sensing location 74 and at a lower elevation than the third sensing location 74. The fourth sensing location 80 is preferably adjacent the second end 48' of the first end portion 32 of the second load carrying member 24 and between the third and fourth surfaces 40',42' of the second load carrying members 24 first end portion 32'. Because the fourth sensing means 76 is located between the first side 36 and second side 38', the potential for damage due to impact, as discussed with respect to the other sensors, will be substantially reduced due to the shielding effect of the load carrying members 22, 24.

A first reflecting means 82 is provided for receiving the first signal 60 at a first reflecting location 84 adjacent the second end portion 32 of the first load carrying member 22 and for delivering a reflection of the first signal 60 in a direction toward the first sensing means 58. The first reflecting means 82 is connected to the first surface 36 of the first load carrying member 22 and located between the third and fourth surfaces 40,42 and the first and third surfaces 36,38 of the first and second load carrying members 22,24. Being so located will reduce the potential for damage since the first and second load carrying members 22,24 shield the first reflecting means. The first reflecting location is preferably adjacent the first end 46 of the first load carrying member first end portion 32. A second reflecting means 86 receives the second signal 66 at a second reflecting location 88 adjacent the second end portion 34 of the first load carrying member 22 and delivers a reflection of the second signal 66 in a direction toward the second sensing means 64. The second reflecting means 86 is connected to the first surface 36 of the first load carrying member 22 and is located between the third and fourth surfaces 40,42 and the first surface 36 of the first load carrying member 22 and the second surface 38 of the second load carrying member 24. Being so located will reduce the potential for damage as the first and second load carrying members will shield the second reflecting means 86 from impact by external objects. The first and second reflecting locations 84,88 are spaced from one another along the second end portion 34 of the first load carrying member 22. The second reflecting location is preferably adjacent the second end 52 of the first load carrying member second end portion 34. A third reflecting means 90 is provided for receiving the third signal 72 at a third reflecting location 92 adjacent the second end portion 34 of the second load carrying member 24 and for delivering a reflection of the third signal 72 in a direction toward the third sensing means 70. The third reflecting means is connected to the second surface 38' of the second load carrying member second end portion 34' and located between the third and fourth surfaces 40',42' and the first surface 36 of the first load carrying member 22 and the second surface 38' of the second load carrying member 24. Thus, the third reflecting means is protected by the first and second load carrying members 22,24 and shielded from contact with external objects. The third reflecting means is located adjacent the first end 50 of the second load carrying member 24 second end portion 34'.

A fourth reflecting means 94 receives the fourth signal 78 at a fourth location 96 adjacent the second end portion 34' of the second load carrying member 24 and delivers a reflection of the fourth signal 78 in a direction toward the fourth sensing means 76. The fourth reflecting means 94 is connected to the second surface 38' of the second load carrying member 24 second end portion 34' and is located between the third and fourth surfaces 40,42 of the second load carrying member 24 and between the first surface 36 of the first load carrying member 22 and the second surface 38' of the second load carrying member 24. Thus, the fourth reflecting means 94 is shielded by the first and second load carrying members 22,24 and protected from damage due to impact by external objects. The fourth reflecting location 96 is adjacent the second end 52' of the second load carrying member second end portion 34' and spaced from the third reflecting location 92.

The first sensing means 58 is positioned to deliver the first signal 60 at a preselected angle "a" relative to the third surface of the first end portion 32 and the second sensing means 64 is positioned to deliver the second signal 66 at a second preselected angle "b" relative to the third surface 40 of the second end portion 34. The third sensing means 70 is positioned to deliver the third signal 72 at a third preselected angle "c" (not shown) relative to the third surface 40' of the second load carrying member first end portion 32' and the fourth sensing means 76 is positioned to deliver the fourth signal 78 at a fourth preselected angle "d" (not shown) relative to the third surface 40' of the second load carrying member second end portion 34'. First angle "a" is substantially equal to third angle "c" and second angle "b" is substantially equal to fourth angle "d". Preferably, the first angle "a" has a magnitude in the range of between 1.0 degrees and 10.0 degrees and the second angle "b" has a magnitude in the range of between 2.0 degrees and 8.0 degrees. With the sensing means 58,64,70,76 all properly adjusted relative to the first, second, third, and fourth reflecting means 82,86,90,94, the first and second signals 60,66 will intersect each other at a location spaced outwardly from the third surface 40 of load carrying member 22 and the third and fourth signals 72,78 will intersect at a location spaced outwardly from the third surface 40' of the second load carrying member 24. It should be noted that the first and second signals not only intersect at a first crossing location spaced outwardly from the first end portion 32 of the first load carrying member 22 but also elevationally above the second end portion 34 of the first load carrying member 22. Also, it should be noted that the third and fourth signals 72,78 not only intersect at a second crossing location spaced outwardly from the first end portion 32' of the second load carrying member 24 but also elevationally above the second end portion 34' of the second load carrying member 24. It should be noted that when the load is squarely and properly positioned on the first and second load carrying members 22,24, the first, second, third, and fourth delivered and reflected signals will be blocked.

The first, second, third, and fourth sensing means 58,64,70,76 each include a transceiver 98 having an infrared light emitting and receiving portion of any suitable type known in the art. The light emitting and receiving portion 100 of the second and fourth sensing means 64,76 differ from the first and third sensing means 58,70 in that they have means 102 for directing the second and fourth signals at a right angle to the light emitting and receiving portion so that the second and fourth sensing means 64,76 may be located between or adjacent third and fourth surfaces 40,40',42,42' while delivering the second and fourth signals 66,78 at the proper angles b, b'. Means 102 preferably includes a mirror (not shown); however, prisms, lenses, and the like may be utilized to properly direct the infrared light. The sensing means 58,64,70,76 are connected to their respective first and second load carrying members 22,24 in any suitable manner.

The first, second, third, and fourth reflecting means 82,86,90,94 each include a bracket 104 which has a planar surface 106 and a retroreflective material 108 affixed to the planar surface of 102 of each of the brackets 104. The brackets 104 of the first and second reflecting means 82,86 are connected to the first surface 36 at the first and second reflecting locations 84,88 in any suitable manner such as by welding, threaded fasteners, or the like. And the brackets 104 of the third and fourth reflecting means 90,94 are connected to the first surface 36' of the second load carrying member 24 at the third and fourth reflecting locations 92,96 in any suitable manner such as welding, threaded fasteners, and the like. It is to be noted that the reflecting means 104 of the first and third reflecting means 82,90 are identical rectangular shaped members and the bracket 104 of the second and third reflecting means 86 and 94 have a tapered streamline configuration for streamlining purposes.

First and second elongated covers 110,112 are provided for shielding the first, second, third, and fourth sensing means 58,64,70,76 from debris, impact, and the like and protect the sensors disposed therebeneath. The first and second elongated covers 110,112 are substantially identical in construction but mirror images of each other. As best seen in FIGS. 2 and 3, the covers 110,112 each have first and second spaced apart sides 114,116 and a third side 118 connected to and between the first and second sides 114,116. The covers 110,112 have first and second spaced apart ends 120,122 and an opening 124 at each of the first and second spaced apart cover ends. The first end 120 of the first cover 110 is adjacent the first end 46 of the first load carrying member first end portion 32 and the first end 120 of the second cover 112 is adjacent the first end 46' of the second load carrying member first end portion 32'. The first, second, third, and fourth sensing means 58,64,70,76 each have an electrical current conducting wire 126 which extends from beneath the covers 112,114 and passes through the opening 124 at the covers first end 120. Means 128 for passing the first, second, third, and fourth signals 60,66,72,76 and a reflection of the first, second, third, and fourth signals through the first side 114 of the adjacent first and second covers 114,116 is provided. The means 128 includes an opening in the first side 114 of each cover 110,112 at a location in the pathway of the first, second, third, and fourth delivered and reflected signals 60,66,72,78. It is to be noted that although we described the passing means 128 as being openings in the first side, it is evident that alternative ways of passing the signals such as utilizing a transparent material for at least the first side 114 of the first and second covers 110,112 is within the scope of the invention.

A closure means 132 is provided for sealing the opening at the first end 120 of each of the first and second covers 110,112. Closure means 132 preferably includes a formed rubber grommet 134 disposed in the opening 124 and in sealing engagement with the conducting wires 126. The rubber grommet 134 thus reduces the potential for dirt, moisture, and the like from entering beneath the cover at the openings 124 at the first end 120 of the covers 110,112 and reduces the potential for damage of the conducting wires 126 due to wire flexing, rubbing, etc. with the covers 110,112. It is to be noted that debris which enters the openings 130 will freely fall through and out the opening 124 at the cover second end 122.

A fastening means 136 secures the first cover 100 to the first surface 36 of the first load carrying member 22 at the first end portion 32 of the first load carrying member 22 and secures the second cover 112 to the first surface 36' of the second load carrying member 24 at the first end portion 32' of the second load carrying member 24. The first cover 110 extends along the first end portion 32 of the first load carrying member 22 and overlies at least a portion of the first and second sensing means 58, 64, and the second cover 112 extends along the first end portion 32' of the second load carrying member 24 and overlies at least a portion of the third and fourth sensing means 70,76. The fastening means 136 includes a plurality of threaded fasteners 138 screwthreadably removably connected to the first and second load carrying members 22,24.

An actuator means 140 is provided for shifting the support flange 26 in directions transverse the spaced apart uprights 18 so that the first and second load carrying members 22,24 may be aligned with the load 44 to be lifted. The actuator means 140 is shown as a linear hydraulic motor 142. However, other embodiments, for example, electric and pneumatic motors, may be utilized and remain within the scope of the invention.

A lift jack 144 of conventional construction and of preferably the fluid operated type is operatively connected to the lift mast assembly in a conventional and well-known manner. The lift jack 144 is extensibly movable for elevationally moving the carriage 20 elevationally along the spaced apart uprights 18. The lift jack 144 is connected to a source of pressurized fluid 146 which is selectively directed from the first pressurized fluid 146 to the jack 144 by a three position, three way solenoid operated control valve 148. The source 146 is also connected to the actuator means 140 and the fluid delivered from source 146 is directed to the hydraulic motor 142 by control valve 150. Control valve 150 is preferably a solenoid operated valve capable of modulating and directing fluid flow to and from the actuator means 140 so that speed and direction may be satisfactorily controlled. An electric motor 152 is drivingly coupled to the source of pressurized fluid flow 146 and a motor control 154 of any suitable well-known design controls the speed of the motor 152 in response to control signals received by the motor control 154. A control means 156, which is preferably programmable, receives the first, second, third, and fourth controlling signals delivered from the first, second, third, and fourth sensing means 58,64,70,76 and enables the power means 144 to move the carriage 20 along the uprights 18 in response to receiving the first, second, third, and fourth controlling signals. The first sensing means 58 delivers the first controlling signal in response to the reflection of the first signal 60 being blocked from the first sensing means 58. The second sensing means 64 delivers a second controlling signal in response to the reflection of the second signal 66 being blocked from the second sensing means 64. The third sensing means 70 delivers the third controlling signal in response to the reflection of the third signal 72 being blocked from the third sensing means 70, and the fourth sensing means 76 delivers the fourth controlling signal in response to the reflection of the fourth signal 78 being blocked from the fourth sensing means 76. It should be recognized that each of the first, second, third, and fourth signals 60,66,72,78 are blocked only when the load 44 is disposed within the path of each of the first, second, third, and fourth signals 60,66,72,78. The control means 156 receives the first, second, third, and fourth control signals via conductor pairs 158,160 and enables the control means 156 to deliver a control signal via conduit 162 or 164 to the solenoid operated control valve 148. It is to be noted that the control means 156 responds to other controlling signals which for example, control the direction of shifting of the solenoid operated control valve 148 and motor operation.

Industrial Applicability

With reference to the drawings, the load lifting device 15, as applied to automatic guided vehicles, ensures accuracy of load placement and pick up by providing first, second, third, and fourth sensing and reflecting means 58,82,64,86,70,90,76,94. The automatic guided vehicle 10 automatically positions the second ends 52,52' relative to the load 44 so that the first and second load carrying members 22,24 may be moved beneath the load 44. The actuator means 140 assists in transverse positioning of the first and second load carrying members relative to the vehicle and load 44 to be lifted. Upon completion of proper alignment between the first and second load carrying members 22,24 and the load 44 the automatic guided vehicle 10 will travel in a direction towards the load 44 until the first and third signals 60,72 are obstructed by the load 44. Blocking of the first and third signals 60,72 causes the first and third sensing means 58,70 to deliver the first and third control signals to control unit 156. The control unit 156 responds to these signals and causes elevational movement of the first and second load carrying members 22,24 by delivering a control signal via conduit 162 to the solenoid operated control valve 148. The solenoid operated control valve responds by shifting to deliver fluid from the source of pressurized fluid 146 to power means 144 which elevates the carriage 20 and first and second load carrying members 22,24 supported thereon a preselected amount or until the reflections of the second and fourth signals 66,78 are blocked from the second and fourth sensing means 64,76. When the reflections of the second and fourth signals 66,78 are blocked, the second and fourth sensing means 64,76 delivers the second and fourth controlling signals to the control unit 156. The control unit 156 responds to the second and fourth controlling signals in a predetermined manner and according to preselected program instructions. For example, the control means 156 may raise the load 44 to a preselected height for transportation purposes by the vehicle 10.

It should be noted that if any one of the first, second, third, and fourth sensing means 58,64,70,76 should malfunction and not deliver their respective first, second, third, and fourth control signals, the control means 156 will respond in a preselected manner, for example, by notifying the central control unit (not shown) of a potential problem. Thus, it can be seen that if a load to be lifted should be cocked, skewed, and the like, one of the first, second, third, and fourth signals 60,66,72,78 and/or the reflection thereof will not be blocked and therefore corrective action will be taken.

Since the first, second, third, and fourth sensing means 58,64,70,76 are disposed between the first and second load carrying members and between the third and fourth surfaces 40,42,40',42', the potential for damage thereof is reduced. In addition, the first and second elongated covers 110,112 provide additional protection from impact with objects and also reduce the potential for damage by smaller objects, debris, and the like.

The first, second, third, and fourth sensing means 58,64,70,76 also assist the vehicle in placing the load at the desired location by identifying when the load is free from engagement with the load carrying members second end portions 34,34' and the first end portion 32,32' thereof. Because the first, second, third, and fourth sensing means are fixed relative to the first and second load carrying members 22,24 and free from engagement with the load 44, problems associated with adjustment caused by movements thereof will be eliminated.

Other aspects, objects, and advantages of this invention can be obtained from a study of the drawings, the disclosure, and the appended claims.

We claim:

1. A load lifting device, comprising:

a load carrying member having a first end portion and a second end portion extending outwardly from said first end portion;

a first sensing means for delivering a first signal from a first sensing location adjacent said first end portion and receiving a reflection of said first signal;

a second sensing means for delivering a second signal from a second sensing location adjacent said first end portion and receiving a reflection of said second signal, said second sensing location being positioned at a lower elevation than said first sensing location;

a first reflecting means for receiving said first signal at a first reflecting location adjacent the second end portion and delivering a reflection of said first signal in a direction toward said first sensing means;

a second reflecting means for receiving said second signal at a second reflecting location adjacent the second end portion and delivering a reflection of said second signal in a direction toward said second sensing means, said first and second reflecting location being spaced from one another, said sensing and reflecting means being free from contact with a load carried on the load carrying member and providing accurate sensing of the position of the load on the load carrying member.

2. A load lifting device, as set forth in claim 1, wherein said first and second end portions each have first and second ends, said first sensing location being adjacent the first end of the first end portion and said second sensing location being adjacent the second end of the first end portion.

3. A load lifting device, as set forth in claim 2, wherein said load carrying member has first and second spaced apart surfaces, said first and second sensing and reflecting means each being connected to a common one of the first and second surfaces of the load carrying member.

4. A load lifting device, as set forth in claim 3, wherein said load carrying member has third and fourth spaced apart surfaces extending between said first and second surfaces, said first and second sensing and reflecting means each being connected to the first surface of the load carrying member at a location between said third and fourth surfaces.

5. A load lifting device, as set forth in claim 3, including:

a cover having first and second spaced apart sides and a third side connected to and between said first and second sides;

fastening means for securing the cover to the first surface of the load carrying member at the first end portion of the load carrying member, said cover extending along the first end portion of the load carrying member and overlying at least a portion of the first and second sensing means.

6. A load lifting device, as set forth in claim 5, wherein said cover has first and second spaced apart ends and an opening at each of the first and second spaced apart cover ends, said cover first end being adjacent the first end of the load carrying member first end portion, said first and second sensing means each having an electrical current conducting wire extending from beneath said cover and through the opening at the cover first end.

7. A load lifting device, as set forth in claim 6, including closure means for sealing the opening at the first end of the cover.

8. A load lifting device, as set forth in claim 5, including an opening on the first side of the cover at a location in the pathway of said first and second delivered and reflected signals.

9. A load lifting device, as set forth in claim 4, wherein said first sensing means is positioned to deliver said first signal at a first preselected angle "a" relative to the third surface of the first end portion and said second sensing means is positioned to deliver said second signal at a second preselected angle "b" relative to the third surface of the second end portion.

10. A load lifting device, as set forth in claim 9, wherein said first angle "a" has a magnitude in the range of between 1.0 degrees and 10.0 degrees and said second angle "b" has a magnitude in the range of between 2.0 degrees and 8.0 degrees.

11. A load lifting device, as set forth in claim 9, wherein said first and second signals intersect at a location spaced outwardly from said third surface of the load carrying member.

12. A load lifting device, as set forth in claim 4, wherein said first and second reflecting means each include:

a bracket having a planar surface and being connected to the first surface of the load carrying member; and a retroreflective material affixed to the planar surface of said bracket.

13. A load lifting device, as set forth in claim 4, wherein said first and second sensing means each have an infrared light emitting and receiving portion.

14. A lift mast assembly, comprising:

a pair of spaced apart uprights;

a carriage mounted on and movable along said pair of spaced apart uprights;

a first load carrying member having a first end portion and a second end portion extending outwardly from said first end portion;

a second load carrying member having a first end portion and a second end portion extending outwardly from said second load carrying member first end portion, said first end portions of the first and second load carrying members being connected to the carriage at spaced apart locations;

a first sensing means for delivering a first signal from a first sensing location adjacent the first end portion of the first load carrying member and receiving a reflection of said first signal;

a second sensing means for delivering a second signal from a second sensing location adjacent said first end portion of the first load carrying member and receiving a reflection of said second signal, said second sensing location being at a lower elevation then said first sensing location;

a third sensing means for delivering a third signal from a third sensing location adjacent said first end portion of the second load carrying member and reflection of said third signal;

a fourth sensing means for delivering a fourth signal from a fourth sensing location adjacent said first end portion of the second load carrying member and receiving a reflection of said fourth signal, said fourth sensing location being positioned at a lower elevation than said third sensing location;

a first reflecting means for receiving said first signal at a first reflecting location adjacent the second end portion of the first load carrying member and delivering a reflection of said first signal in a direction toward said first sensing means;

a second reflecting means for receiving said second signal at a second reflecting location adjacent the second end portion of the first load carrying member and delivering a reflection of said second signal in a direction toward said second sensing means, said first and second reflecting locations being spaced from one another;

a third reflecting means for receiving said third signal at a third reflecting location adjacent the second end portion of the second load carrying member and delivering a reflection of said third signal in a direction toward said third sensing means; and a fourth reflecting means for receiving said fourth signal at a fourth reflecting location adjacent the second end portion of the second load carrying member and delivering a reflection of said fourth signal in a direction toward said fourth sensing means; said third and fourth reflecting locations being spaced from one another, said sensing and reflecting means being free from contact with a load carried on the load carrying members and providing accurate sensing of the position of the load on the load carrying members.

15. A lift mast assembly, as set forth in claim 14, wherein said first sensing means is positioned to deliver said first signal at a first preselected angle "a" relative to the first end portion of said first load carrying member, said second sensing means being positioned to deliver said second signal at a second preselected angle "b" relative to the first end portion of said first load carrying member, said third sensing means being positioned to deliver said third signal at a third preselected angle "c" relative to the first end portion of the second load carrying member, and said fourth sensing means being positioned to deliver said fourth signal at a fourth preselected angle "d" relative to the second end portion of the second load carrying member.

16. A lift mast assembly, as set forth in claim 15, wherein said first and second signals intersect at a crossing location spaced outwardly from the first end portion of the first load carrying member and elevationally above the second end portion of the first load carrying member, and said third and fourth signals intersect at a crossing location spaced outwardly from the first end portion of the second load carrying member and elevationally above the second end portion of the second load carrying member.

17. A lift mast assembly, as set forth in claim 14, wherein said first sensing means delivering a first controlling signal in response to the reflection of said first signal being blocked from said first sensing means, said second sensing means delivering a second controlling signal in response to the reflection of said second signal being blocked from said second sensing means, said third sensing means delivering a third controlling signal in response to the reflection of said third signal being blocked from said third sensing means, and said fourth sensing means delivering a fourth controlling signal in response to the reflection of said fourth signal being blocked from said fourth sensing means, including:

power means for moving said carriage along said uprights; and control means for receiving said first, second, third, and fourth controlling signals and enabling said power means to move said carriage along said uprights in response to receiving said first, second, third, and fourth controlling signals.

18. A lift mast assembly, as set forth in claim 14, wherein said first and second load carrying members each have first and second spaced apart opposed surfaces, said first surface of the first load carrying member being spaced from the second surface of the second load carrying member and said first surface of the first load carrying member facing the second surface of the second load carrying member, said first and second sensing and reflecting means being connected to the first surface of the first load carrying member and said third and fourth sensing and reflecting means being connected to the second surface of the second load carrying member, said first, second, third, and fourth sensing and reflecting means being positioned between said first and second load carrying members.

19. A lift mast assembly, as set forth in claim 18, wherein the first and second end portions of the first and second load carrying members first and second end portions each have first and second ends said first sensing location being adjacent the first end of the first load carrying member first end portion, said second sensing location being adjacent the second end of the first load carrying member first end portion, said third sensing location being adjacent the first end of the second load carrying member first end portion, and said fourth sensing location being adjacent the second end of the second load carrying member first end portion, said first reflecting location being adjacent the first end of the first load carrying member second end portion, said second reflecting location being adjacent the second end of the first load carrying member second end portion, said third reflecting location being adjacent the first end of the second load carrying member second end portion, and said fourth reflecting location being adjacent the second end of the second load carrying member second end portion.

20. A lift mast assembly, as set forth in claim 18, including:

first and second elongated covers each having first and second sides and a third side connected to and between the first and second sides, said first cover being positioned in a covering relationship relative to the first and second sensing means and being connected to the first surface of the first load carrying member and said second cover being positioned in a covering relationship relative to the third and fourth sensing means and being connected to the second surface of the second load carrying member; and means for passing said first, second, third, and fourth signals and the reflection of said first, second, third, and fourth signals through the first side of a respectively adjacent one of the first and second covers.

21. A lift mast assembly, as set forth in claim 18, wherein said carriage includes a support flange having first and second spaced apart guide surfaces, said first and second load carrying members each having an "L" shaped configuration and first and second hooks mounted at spaced apart locations on the first end portion of each of the first and second load carrying members, said first and second hooks being slidably engaged with the first and second guide surfaces, respectively.

22. A lift mast assembly, as set forth in claim 21, wherein said carriage includes a actuator means for shifting said support flange in directions transverse the pair of spaced apart uprights.

23. An automatic guided vehicle, comprising:

a vehicle frame having a longitudinal axis;

a pair of spaced apart elevationally oriented uprights connected to said vehicle frame and longitudinally movable along said longitudinal axis between spaced apart locations on said vehicle frame;

a carriage mounted on and movable along said pair of spaced apart uprights between elevationally spaced apart positions;

a first load carrying member having a first end portion and a second end portion extending outwardly from said first end portion;

a second load carrying member having a first end portion and a second end portion extending outwardly from said second load carrying member first end portion, said first end portions being elevationally oriented and connected to the carriage at spaced apart locations;

a first sensing means for delivering a first signal from a first sensing location adjacent the first end portion of the first load carrying member and receiving a reflection of said first signal;

a second sensing means for delivering a second signal from a second sensing location adjacent the first end portion of the first load carrying member and receiving a reflection of said second signal, said second sensing location being positioned at a lower elevation than said first sensing location;

a third sensing means for delivering a third signal from a third sensing location adjacent the first end portion of the second load carrying member and receiving a reflection of said third signal;

a fourth sensing means for delivering a fourth signal from a fourth sensing location adjacent the first end portion of the second load carrying member and receiving a reflection of said fourth signal, said fourth sensing location being positioned at a lower elevation than said sensing location;

a first reflecting means for receiving said first signal at a first reflecting location adjacent the second end portion of the first load carrying member and delivering a reflection of said first signal in a direction toward said first sensing means;

a second reflecting means for receiving said second signal at a second reflecting location adjacent the second end portion of the first load carrying member and delivering a reflection of said second signal in a direction toward said second sensing means, said first and second reflecting locations being spaced from one another;

a third reflecting means for receiving said third signal at a third reflecting location adjacent the second end portion of the second load carrying member and delivering a reflection of said third signal in a direction toward said third sensing means;

a fourth reflecting means for receiving said fourth signal at a fourth reflecting location adjacent the second end portion of the second load carrying member and delivering a reflection of said fourth signal in a direction toward said fourth sensing means, said third and fourth reflecting locations being spaced from one another, said sensing and reflecting means being free from contact with a load carried on the load carrying members and providing accurate sensing of the position of the load on the load carrying members.

24. A lift mast assembly, as set forth in claim 23, wherein said first, second, third, and fourth sensing means deliver a respective first, second, third, and fourth control signal in response to said reflection of the respective first, second, third, and fourth signals, being blocked from said first, second, third, and fourth sensing means, respectively, including:

power means for elevationally moving the carriage between said elevationally spaced apart positions;

control means for receiving said first, second, third, and fourth control signals and enabling said power means to elevationally move said carriage in response to receiving said first, second, third, and fourth control signals, said control means being connected to said first, second, third, and fourth sensing means and said power means.

* * * * *

UNITED STATES PATENT AND TRADEMARK OFFICE

CERTIFICATE OF CORRECTION

PATENT NO. : 4,751,983

DATED : June 21, 1988

INVENTOR(S) : Edward V. Leskovec and Richard A. Schwehr

It is certified that error appears in the above-identified patent and that said Letters Patent is hereby corrected as shown below:

Column 17, line 8, Claim 23, after "said" insert --third--.

Signed and Sealed this

Fourteenth Day of March, 1989

*Attest:*

DONALD J. QUIGG

*Attesting Officer*

*Commissioner of Patents and Trademarks*